US011382425B2

(12) United States Patent
Andschus

(10) Patent No.: US 11,382,425 B2
(45) Date of Patent: Jul. 12, 2022

(54) WALL FOR A PIECE OF FURNITURE, METHOD FOR PRODUCING SUCH A WALL, AND FURNITURE BODY OR PIECE OF FURNITURE HAVING SUCH A WALL

(71) Applicant: AMBIGENCE GMBH & CO. KG, Herford (DE)

(72) Inventor: Stefan Andschus, Lübbecke (DE)

(73) Assignee: AMBIGENCE GMBH & CO. KG, Herford (DE)

( * ) Notice: Subject to any disclaimer, the term of this patent is extended or adjusted under 35 U.S.C. 154(b) by 0 days.

(21) Appl. No.: 17/267,225

(22) PCT Filed: Aug. 5, 2019

(86) PCT No.: PCT/EP2019/071040

§ 371 (c)(1),
(2) Date: Feb. 9, 2021

(87) PCT Pub. No.: WO2020/030602

PCT Pub. Date: Feb. 13, 2020

(65) Prior Publication Data

US 2021/0212466 A1 Jul. 15, 2021

(30) Foreign Application Priority Data

Aug. 10, 2018 (DE) ..... 10 2018 119 539

(51) Int. Cl.
*A47B 96/20* (2006.01)
*E05D 15/40* (2006.01)
*E05F 1/12* (2006.01)

(52) U.S. Cl.
CPC ..... *A47B 96/205* (2013.01); *E05D 15/40* (2013.01); *E05F 1/12* (2013.01); *E05Y 2600/41* (2013.01);
(Continued)

(58) Field of Classification Search
CPC ..... E05D 15/463; E05D 15/40; A47B 77/00; A47B 55/04; A47B 96/205; E05F 1/12;
(Continued)

(56) References Cited

U.S. PATENT DOCUMENTS 3,472,572 A * 10/1969 Louise ..... A47B 96/202 312/258
3,654,053 A * 4/1972 Toedter ..... A47B 96/202 428/56

(Continued)

FOREIGN PATENT DOCUMENTS

DE 1559963 A1 12/1969
DE 102007011037 A1 10/2007

(Continued)

OTHER PUBLICATIONS

International Search Report dated Nov. 6, 2019 in related/corresponding International Application No. PCT/EP2019/071040.

(Continued)

*Primary Examiner* — Daniel J Troy
*Assistant Examiner* — Timothy M Ayres
(74) *Attorney, Agent, or Firm* — Patent Portfolio Builders PLLC

(57) ABSTRACT

A method for producing a wall for a piece of furniture involves providing two panel-form core halves, of which at least one has at least one aperture extending only along a portion of a side surface of the core half. A fitting or fitting housing is inserted into the at least one aperture and the two core halves are joining together to form a composite element enclosing the fitting or fitting housing. Side surfaces of the two core halves are located one upon the other. A narrow-surface coating is applied to at least one end surface of the composite element, the end surface being oriented transversely to the side surface. An opening is formed in a portion (Continued)

Figure 1:
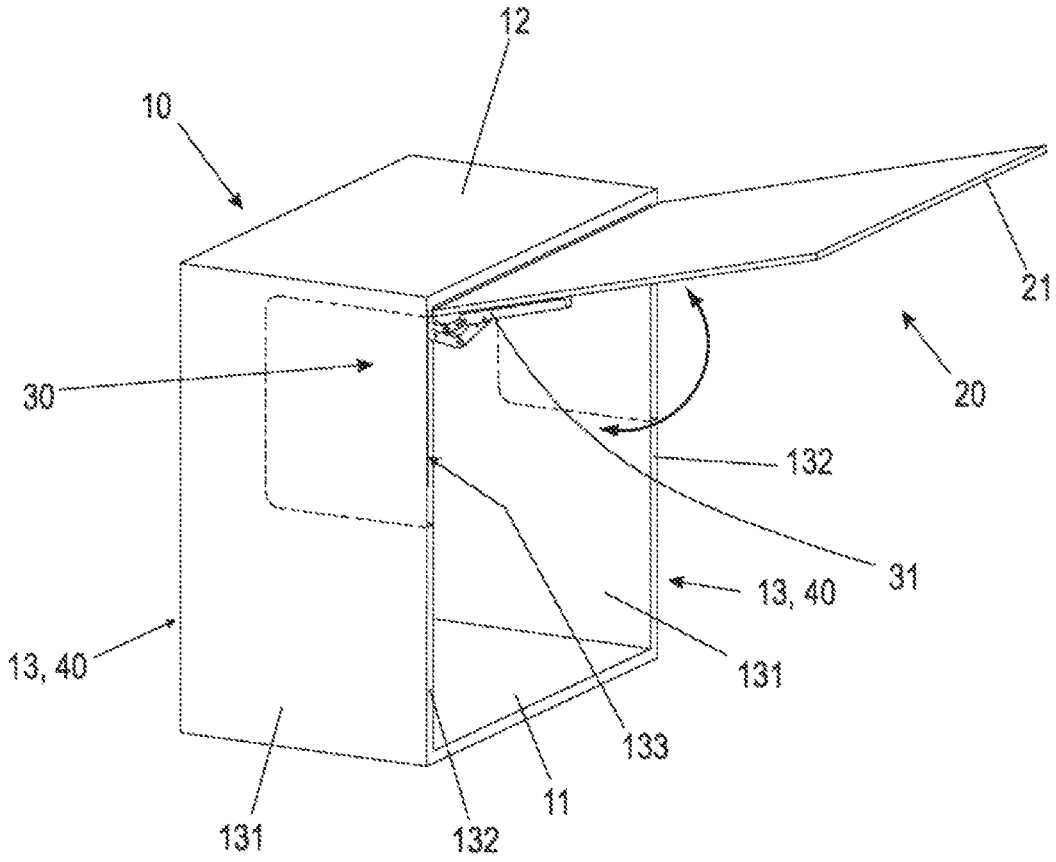

of the at least one end surface. The opening extends as far as the fitting, or the fitting housing.

20 Claims, 6 Drawing Sheets

(52) U.S. Cl.
CPC ... *E05Y 2600/502* (2013.01); *E05Y 2600/526* (2013.01); *E05Y 2600/53* (2013.01); *E05Y 2900/20* (2013.01)

(58) Field of Classification Search
CPC ..... E05Y 2600/452; E05Y 2600/41; E05Y 2900/20
USPC ..... 49/205; 312/348.4
See application file for complete search history.

(56) References Cited

U.S. PATENT DOCUMENTS

| | | | | |
|---|---|---|---|---|
| 6,471,312 | B1 * | 10/2002 | Coffey | E05D 7/083 312/328 |
| 7,540,577 | B2 | 6/2009 | Netzer | |
| 10,588,407 | B2 | 3/2020 | Held | |
| 11,085,218 | B2 * | 8/2021 | Herper | E05F 1/1246 |
| 2007/0228906 | A1 * | 10/2007 | Netzer | A47B 88/956 312/348.4 |
| 2014/0239787 | A1 * | 8/2014 | Mensa' | A47B 88/956 312/348.4 |
| 2014/0291262 | A1 * | 10/2014 | Choe | B32B 3/04 428/167 |
| 2019/0316394 | A1 * | 10/2019 | Kruedener | E05F 1/1058 |
| 2019/0316398 | A1 * | 10/2019 | Kruedener | E05D 15/46 |
| 2019/0380495 | A1 * | 12/2019 | Sobolewski | A47B 77/00 |
| 2019/0380496 | A1 * | 12/2019 | Poppenborg | E05D 15/262 |
| 2020/0008578 | A1 * | 1/2020 | Sobolewski | A47B 96/04 |
| 2020/0008579 | A1 * | 1/2020 | Sobolewski | A47B 96/04 |
| 2020/0060422 | A1 * | 2/2020 | Sobolewski | E05D 15/463 |
| 2021/0010311 | A1 * | 1/2021 | Nordieker | E05F 1/1058 |
| 2021/0087867 | A1 * | 3/2021 | Folie | E05D 3/14 |
| 2021/0123275 | A1 * | 4/2021 | Hammerer | E05D 7/0407 |
| 2021/0270070 | A1 * | 9/2021 | Holzapfel | A47B 96/20 |
| 2021/0310292 | A1 * | 10/2021 | Tasche | E05D 15/16 |

FOREIGN PATENT DOCUMENTS

| | | | | |
|---|---|---|---|---|
| DE | 102015113427 | A1 | 2/2017 | |
| FR | 1548093 | A | 11/1968 | |
| WO | 2017029199 | A1 | 2/2017 | |
| WO | 2017121678 | A1 | 7/2017 | |
| WO | WO-2018158154 | A1 * | 9/2018 | A47B 77/00 |
| WO | WO-2018158155 | A1 * | 9/2018 | A47B 77/00 |

OTHER PUBLICATIONS

Search Report dated Jun. 24, 2019 in related/corresponding DE Application No. 10 2018 119 539.7.
Written Opinion dated Nov. 6, 2019 in related/corresponding International Application No. PCT/EP2019/071040.

* cited by examiner

WALL FOR A PIECE OF FURNITURE, METHOD FOR PRODUCING SUCH A WALL, AND FURNITURE BODY OR PIECE OF FURNITURE HAVING SUCH A WALL

BACKGROUND AND SUMMARY OF THE INVENTION

Exemplary embodiments of the invention relate to a wall, in particular a side wall, for a piece of furniture, having an integrated fitting that guides a movable furniture part. Exemplary embodiments of the invention further relate to a method for producing such a wall as well as a furniture body or a piece of furniture having such a wall.

Furniture, in particular kitchen furniture such as base units or wall units, usually have a furniture body open to the front, to which movable furniture parts guided by fittings are mounted. The movably guided furniture parts can be drawers with a drawer front or doors or flaps, which can be used individually or in various combinations in a furniture body. The present application relates, in particular, to the use of doors and flaps as movable furniture parts. In the context of this application, doors and flaps are distinguished by the orientation of their pivot axis, which is vertical in the case of doors and horizontal in the case of flaps.

The doors and flaps can be formed integrally here or consist of several individual parts, such as a folding flap, in which different parts of the flap move relative to each other in the course of movement.

Door hinges are usually used to guide doors, which are arranged on the side of the pivot axis between furniture body and door. A comparable arrangement of hinges can also principally be used for flaps. These hinges are then arranged along an upper side edge of the flap. However, it is often desired to open the flaps in a combined pivoting and sliding movement in order to obtain the greatest possible access to the cabinet interior, e.g., in a wall cabinet, without having to pivot the flap to a horizontal position in which it cannot be reached by the user for closing, or only with difficulty. For this reason, special flap fittings have become established that are not arranged along the pivot axis between the furniture body and the flap, but rather laterally at (usually both) side edges between the flap and the side wall.

Such door hinges or flap fittings for mounting on an inner side of the side wall or side walls of the furniture body are well-known. However, the fittings inevitably protrude into the interior of the furniture body, which on the one hand reduces the usable storage space within the furniture body and on the other hand also impairs the structuring of the interior of the furniture body. The mounted fittings also make it more difficult to clean the interior, in particular the inside of the side wall of the furniture body. Particularly for optical reasons, a side wall on which no fittings are mounted is desirable.

For the assembly of door hinges it is known to mill a pocket into one end surface of a side wall, into which the door hinge can be inserted from the front. In this way the inside of the side wall remains free. A hinge suitable for use in such a milled pocket is known from the publication DE 1 559 963 A, for example.

However, this procedure is only suitable for door hinges with a very small installation depth. This is due to the limited milling depth with which such a pocket can be economically milled into the side wall from the end surface during the production process. The installation thickness of the door hinge inserted into such a milled pocket is also very limited, as side walls in the furniture sector only have a wall thickness of around 16-20 mm (millimeters). During the milling process, a certain minimum wall thickness must remain to the side of the milled pockets, as a wall that is too thin would tear or break already during the milling process or would be so deformed that it no longer has a perfect surface.

Even the use of larger and more complex door hinges is not possible in this way. Flap hinges usually have a large installation depth in the range of more than 10 or 15 cm (centimeters), which cannot be achieved by milling from the end surface.

Exemplary embodiments of the present invention are directed to a wall and a method for the production of a wall for a piece of furniture as well as a piece of furniture or furniture body having a wall, wherein larger fittings, in particular flap fittings but also door hinges with a greater installation depth are accommodated in the wall and the wall has a uniform surface finish. In this case, it should be possible to realize a uniform, continuous and even surface on both the outside and the inside of the wall. In addition, it shall be possible to also provide an end surface, also called a narrow surface, in which an opening for parts of the fitting is formed, with a surface of even and uniform, continuous surface finish in sections outside the opening.

A method according to the invention for producing a wall for a piece of furniture comprises the following steps: providing two panel-form core halves, of which at least one has at least one recess extending only along a portion of a side surface of the core half. A fitting or a fitting housing is inserted into the at least one recess and the two core halves are joined together to form a composite element enclosing the fitting or fitting housing, wherein the side surfaces of both core halves rest on each other. A narrow-surface coating is then applied to at least one end surface of the composite element oriented transversely to the side surface. Finally, an opening reaching up to the fitting or fitting housing is made in a section of the at least one end surface.

The wall according to the invention is thus a composite element consisting of two core halves, wherein either the fitting itself or a housing to accommodate the fitting is already inserted during the production of the wall. Thus, there are no restrictions for the size of the recess, as they are present with the insertion of the recess for the fitting with an already completely prefabricated wall. This means that even large fittings can be used, for example, which in their depth take up the entire or almost entire width of the wall. At the same time, the wall has a preferably integral, continuous top layer on both side surfaces.

During production, the composite element completely surrounds the fitting (or fitting housing), so that the end surfaces of the composite element can be provided with a narrow-surface coating, which can be applied advantageously by known, conventional edge-banding techniques. The opening, which is only made afterwards, then allows fitting components, e.g., a lever mechanism, to still extend out of the wall. Due to this narrow-surface coating, which covers the width of the end surfaces of both core halves, it is no longer visible that the composite element is composed of two separate core halves. Rather, it has the appearance of a single panel, whose side surfaces or end surfaces are each coated continuously and uniformly.

If the fitting itself is not already inserted in the production process, but, for example, a cassette-shaped fitting housing, the actual movement fitting is inserted through this opening into the fitting housing after the opening has been produced. Preferably, the fitting housing and the then inserted fitting have interacting, e.g., latching, mounting elements, so that the fitting can be easily mounted. Different fittings can then be inserted into a composite element prepared with the fitting housing. Furthermore, the fitting can be optionally removed for repair or replacement.

The at least one recess can be milled out of the corresponding core half or core halves, preferably from one of the side surfaces. Alternatively, the core halves, which can be made of a fiber material, for example, can also be produced directly with the at least one recess in a master molding process.

In an advantageous design of the method, the at least one recess, before the step of introducing the opening, protrudes to the at least one end surface except for a material web. The outer side of the material web or the outer sides of two adjacent material webs of the two core halves then provides or provide a continuous surface for the application of the narrow-surface coating. Preferably, the at least one material web and the narrow-surface coating applied to it are then removed for introducing the opening.

In another advantageous design of the method, the opening is milled, lasered, cut, and/or punched out. In this case, as a protection for the integrated fitting, a cover can be inserted between the fitting or the fitting housing and the remaining web on the side of the opening to be made, which cover can be removed after production of the opening on the end surface.

In another advantageous design of the method, the fitting or the fitting housing is bonded to at least one of the two core halves within the at least one recess. In addition or alternatively, the fitting can engage, for example, with staples or claws for its fastening into the core halves. In another alternative type of connection, which is also particularly simple in the production process of the wall, connecting elements are formed from the core halves adjacent to the at least one recess, which engage in the fitting or the fitting housing. The fitting or the fitting housing then has side panels with recesses, wherein the recesses form mating contours in which the connecting elements engage. Core halves and fitting or fitting housing are accordingly placed one inside the other like pieces of a puzzle and are positively connected to each other. The role of connecting elements and recesses as contour and mating contour can of course also be interchanged in such a way that the recess is formed in the core halves and the engaging connecting element in the fitting or the fitting housing.

The two core halves can be glued together and/or joined by means of further joining agents. This creates a wall for a furniture body with a firmly integrated fitting or a firmly integrated fitting housing to accommodate the fitting, which simplifies the production of the furniture body.

In another advantageous design of the method, before applying the narrow-surface coating, the at least one end surface of the composite element oriented transversely to the side surface is formatted to obtain a flat end surface. This can be carried out e.g., by sawing or milling. Due to tolerances in the dimensions of the core halves and/or due to processing tolerances, a step may occur between the end surfaces of the two core halves when the core halves are joined together. By formatting, a flat surface is obtained to which a high-quality narrow-surface coating can be applied.

In another advantageous design of the method, a flat coating is applied to an outer side surface of the core halves opposite the recess before or after joining. It is also preferred to apply the narrow-surface coating to other end surfaces of the composite element in which no opening is made. The result is a furniture wall with a homogeneous, high-quality coating on all sides and with an integrated fitting or integrated fitting holder.

A wall for a piece of furniture according to the invention with an integrated fitting that guides a movable furniture part or an integrated fitting housing to accommodate the fitting is characterized in that the wall is produced as a composite element in a previously described method. This results in the advantages described in connection with the method.

In another advantageous design of the wall, the fitting has a lever mechanism that guides the movable furniture part. Preferably, when the movable furniture part is closed, the lever mechanism is located between outer side surfaces of the wall. The fitting is then so completely integrated into the furniture body that—unavoidably—only the lever mechanism is visible, and also this only occurs when the movable furniture part is open.

Preferably, the wall has a thickness between 15 mm and 20 mm (millimeters). Due to its small dimensions, it corresponds to the thickness of normal furniture walls and, despite the integrated fittings, is in no way inferior in appearance.

A piece of furniture or a furniture body according to the invention has at least one such wall, which is produced according to a previously described method. This results in the advantages described in connection with the wall or the method.

In an advantageous design of the piece of furniture or furniture body, at least one wall is a side wall and/or a partition. The fitting can be a flap fitting or a door fitting.

Within the scope of the application, the wall according to the invention can be placed on any side of the furniture body, regardless of its orientation. In particular, the wall may be arranged in any orientation within the furniture body, in particular vertically, horizontally or diagonally, for example diagonally within the furniture body. In this respect, the wall according to the invention can also be used, for example, as a floor, bottom panel or top panel of a basic structure.

BRIEF DESCRIPTION OF THE DRAWING FIGURES

The invention is explained in more detail in the following by means of exemplary embodiments by reference to the figures, wherein:

FIG. 1 shows an example of a piece of furniture with a wall according to the application; and FIGS. 2 to 6 each show an isometric representation of a wall in accordance with the application at different stages of its production process.

DETAILED DESCRIPTION

FIG. 1 shows an isometric representation of a wall unit, e.g., of a kitchen, as the first exemplary embodiment of a piece of furniture with a (side) wall according to the application.

The wall unit comprises a furniture body 10 with bottom panel 11 and top panel 12 as well as two side walls 13. A rear panel is preferably provided for reasons of stability, among others, but is not shown in this exemplary embodiment.

The furniture body 10 is open to the front to gain access to the interior of the furniture body 10. In the context of the application, "front" is understood to be the direction of the furniture body pointing into the room. A flap arrangement 20 with an integral flap 21 is provided to be able to close the opening of the furniture body 10. The integral flap 21 is pivoted around an (imaginary) horizontal axis. Fittings 30 are provided for this purpose, which are connected to the integral flap 21 with a lever mechanism 31 in the upper area of the integral flap 21.

In this case, the fittings 30 are arranged within the respective side wall 13 (except for the lever mechanism 31, which is extended in the opening position shown). When the flap 21 is closed, the lever mechanism 31 is completely retracted into the side wall 13, except optionally for mounting elements for connection to the flap 21. The area inside the side wall 13 where the fitting 30 is located is indicated by a dashed line in FIG. 1.

The side wall 13 is characterized by side surfaces 131, which are ideally integral and can have the same surface finish over the entire surface. The surface of the integral side walls 131 can create design effects through different patterns, surface finishes, or different colors. This preferably applies to an outer of the side walls 131 as well as to an inner of the side walls 131 facing the interior of the furniture body 10. The side walls 13 also have an end surface 132 (also called narrow surface), which has an opening 133 in the area of fitting 30, into which the lever mechanism 31 of the fitting 30 enters or from which the lever mechanism 31 exits. In the closed state of the flap arrangement 20, the lever mechanism 31 is completely immersed in the opening 133, except for possible fastening means with which it is connected to the integral flap 21.

According to the application, the side walls are 13 composite elements 40, which are explained in more detail in connection with FIGS. 2 to 6.

In the exemplary embodiment of a piece of furniture shown in FIG. 1, the composite elements 40, which form the side walls 13, are characterized by continuous side surfaces with a uniform surface appearance and haptics over the entire surface. In addition, the end surfaces are provided with a narrow-surface coating, which is also uniform and continuous. In particular, the front end surface, which has the opening 133 from which the lever mechanism 31 of the fitting 30 pivots out, is also provided with a continuous narrow-surface coating except for the opening 133.

An exemplary embodiment of a composite element 40, with which this is achieved, is shown in FIGS. 2 to 6 at various stages of its production.

Figure 2:
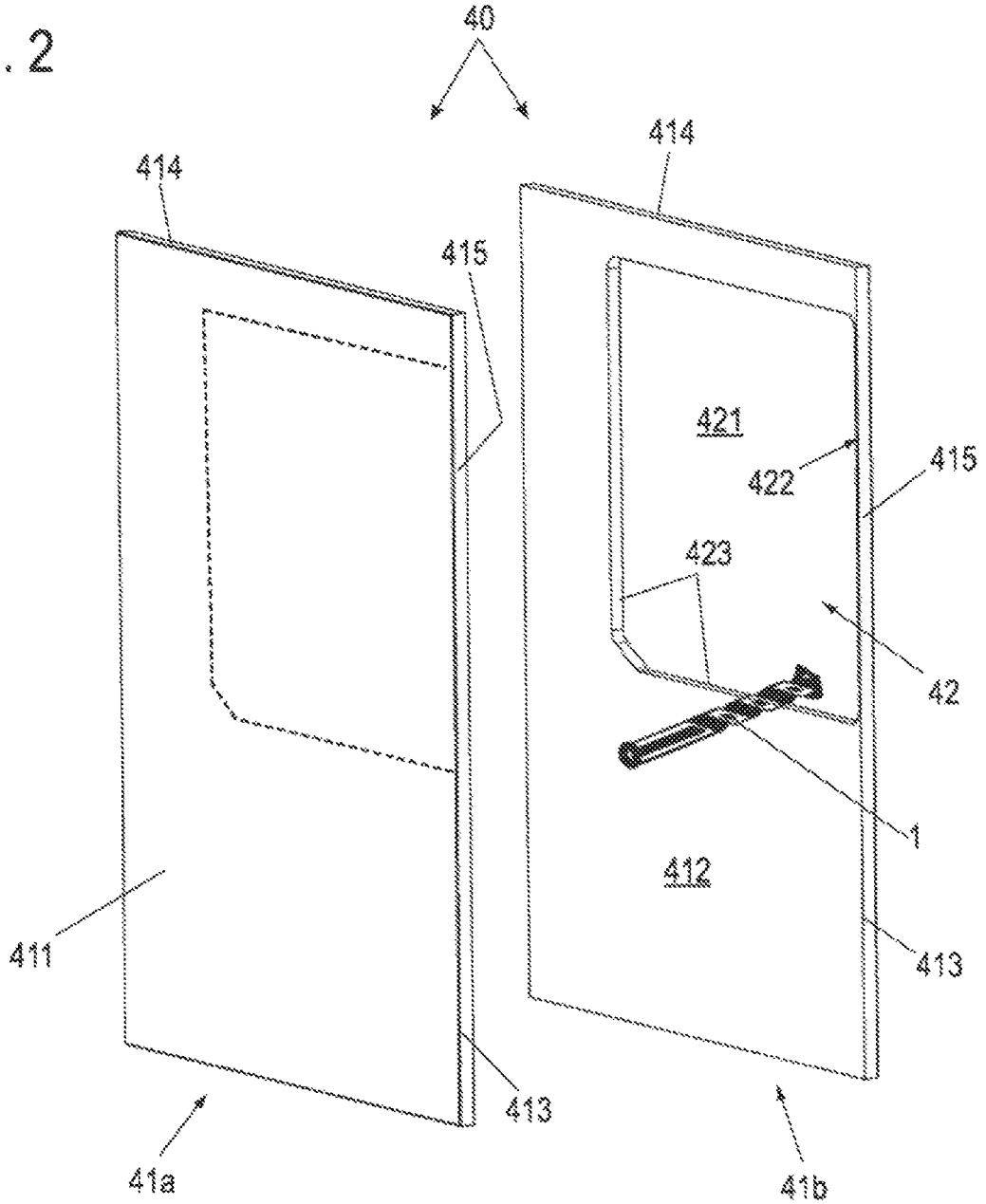

As FIG. 2 shows in an isometric diagram, in a first production step two core halves 41*a*, 41*b* are provided, which later together form the basic element of the composite element 40. In the example shown, the two core halves 41*a*. 41*b* are mirror images of each other.

The core halves 41*a*, 41*b*, for example, are made of a chipboard or a medium or high density fiberboard (MDF—Medium Density Fiberboard or HDF—High Density Fiberboard). The core halves 41*a*, 41*b* each have a rectangular allowance of the size that will later have the side or partition wall in the furniture body to be produced (cf., e.g., side wall 13 of the furniture body 10 according to the example in FIG. 1). A respective outer side surface (also called wide surface) 411 of each core half 41*a*, 41*b* in the joined composite element 40 can already be provided with a coating which will later form the surface of the composite element 40. The coating may comprise a thin layer of wood, paper, plastic or paint. For example, the coating can already be applied to a large area of panel material from which the core halves 41*a*, 41*b* are sawn. Preferably, this coating is already provided with a decorative surface. Its thickness ranges from a few tenths of a millimeter to around 1 or 2 millimeters (mm).

An inner side surface 412 of the core halves 41*a*, 41*b*, i.e., the surface with which the core halves 41*a*, 41*b* lie on top of each other in the composite element 40, can be uncoated. However, there may also be a coating, e.g., with melamine resin paper, which prevents the core half from warping. In addition, the core halves 41*a*, 41*b* each have a front end surface 413 and (in the figures only partially visible) further end surfaces 414. The other end surfaces 414 face up, down and back. The end surfaces 413, 414 are preferably not coated at this stage of the method.

Both core halves 41*a*, 41*b* are each provided with a recess 42, which are as symbolically indicated, milled out of the panel material of the core halves 41*a*, 41*b*, for example, with the aid of a milling tool 1. The contours of the recess 42 of core half 41*a*, which is not visible in FIG. 2, are shown as dashed lines for clarity.

After later joining the two core halves 41*a*, 41*b*, the two recesses 42 form a continuous cavity into which a fitting not yet shown in FIG. 2 is inserted. The recesses 42 have the same geometry in the example shown. They can also be designed differently and in particular have different depths. The shape of the recesses 42 depends on the fitting to be inserted and its outer geometry. For example, the contour of the recesses 42 corresponds to the outer contour of a fitting to be inserted, in this case an approximately rectangular contour. In a special case it is also conceivable that a recess 42 is only inserted into one of the two core halves 41*a*, 41*b*, while the other of the two core halves 41*a*, 41*b* does not have a recess 42.

Even if the core halves 41*a*, 41*b* are of the same thickness in the example shown, the term "core halves" in the context of the application also includes core halves 41*a*, 41*b* of different thicknesses.

The recesses 42 can, for example, each be milled into the core halves 41*a*, 41*b* with the symbolically displayed milling tool 1. Other machining techniques can also be used to create the recesses 42. As an alternative to the machining or ablative process for producing the recess 42, a master molding process (e.g., according to the DIN 8580 standard) can also be used to produce the core halves 41*a*, 41*b*, by means of which the respective core half 41*a*, 41*b* at least partially already obtains its finished shape including the recess 42. With an appropriate forming tool, the recess 42 can also be pressed during the production of the panel.

It needs to be noted that machining can be performed from the inner side surface 412 of the respective core half 41*a*, 41*b*. Thus, the recess can easily assume any depth (as seen from the front end surface 413) and is suitable to accommodate also fittings with a large installation depth. In addition, shapes such as undercuts can be created which are not possible when machining a panel from the end surface.

The recesses 42 are each inserted in such a way that they are disposed completely inside the composite element 40 when the composite element 40 is joined and do not reach the outer surface at any point after the core halves 41*a*, 41*b* have been joined.

This applies to the outer side surfaces 411 opposite the recess 42, of which only the outer side surface 411 of the core half 41*a* is visible in FIG. 2. The recesses 42 thus each have a bottom 421, which may be flat or stepped, adapted to the fitting to be used. In this case, the remaining material thickness of the core halves 41*a*, 41*b* in the area of the bottom can be in the range of several millimeters.

Furthermore, this also applies to all end surfaces 413, 414 of the core halves 41*a*, 41*b* and in particular to the front end surface 413. The lever mechanism 31 of the fitting visible in FIG. 1 will later extend from this front end surface 413. In the first production step of the composite element 40, material respectively remains in the area of the recess 42 along the entire front end surface 413.

A corresponding remaining material web 415 is visible in FIG. 2. The recess 42 adjoins the material web 415 with a front side edge 422. To the rear, top and bottom, the recess is limited by further side edges 423.

Figure 3:
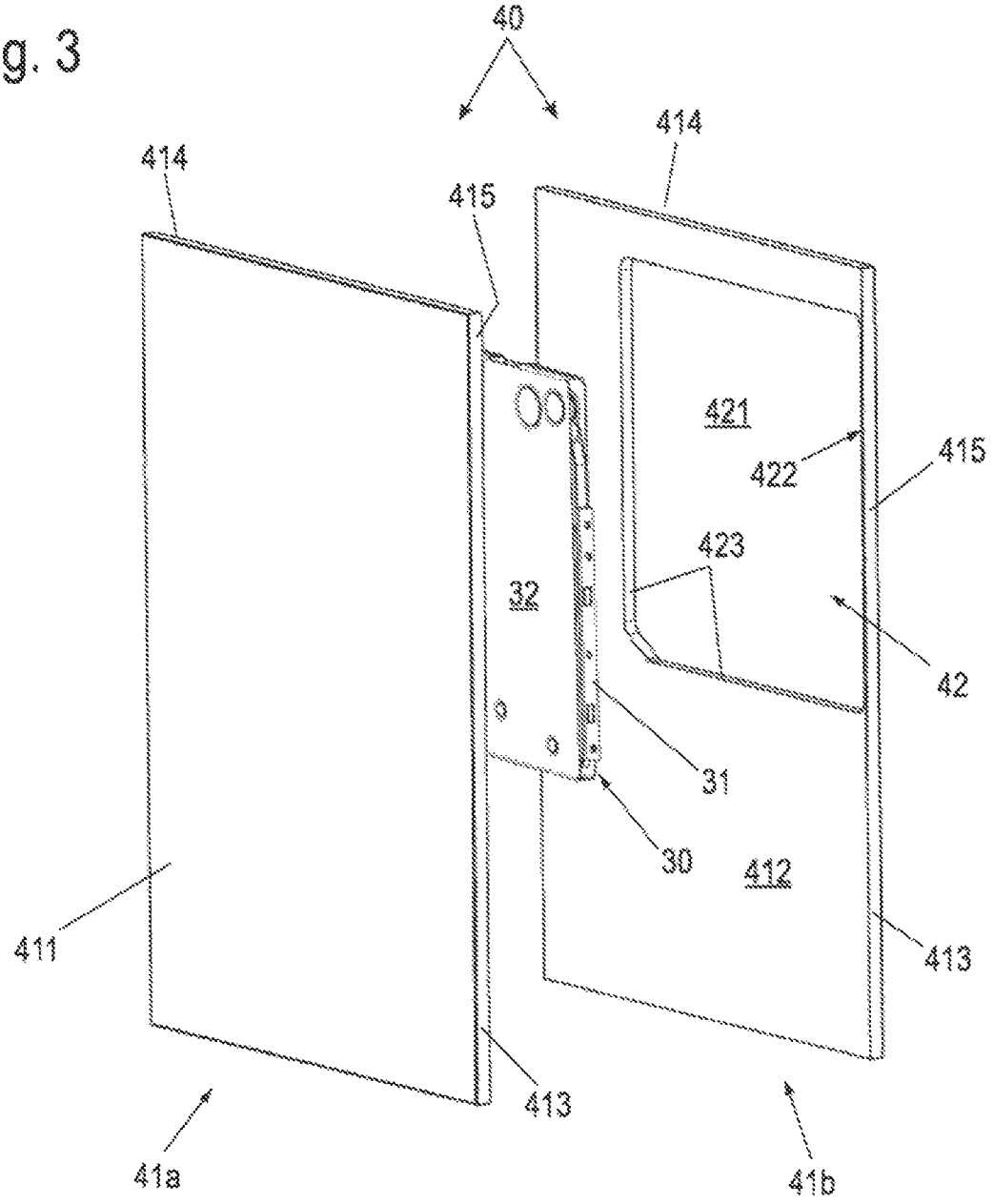

FIG. 3 shows a next processing step, in which a fitting 30 is inserted into the recess 42 and the two core halves 41*a*, 41*b* are joined together with the accommodated fitting 30. For this purpose, the fitting 30 can, for example, be inserted between the two core halves 41*a*, 41*b* in one step, and both core halves 41*a*, 41*b* can be closed and joined together in a next step in the manner of a shell around the fitting 30.

Alternatively, the fitting 30 can first be inserted into one of the recesses 42. Then the second core half 41*a*, 41*b* with its recess 42 is placed over the fitting 30 and the two core halves 41*a*, 41*b* are joined together and connected to each other. To connect fitting 30 to the core halves 41*a*, 41*b* and also to connect the core halves 41*a*, 41*b* to each other, different connecting techniques can be used individually or in combination. For example, it is possible to glue the fitting 30 to the core halves 41*a*, 41*b* over as large an area as possible. In addition, tabs or claws can be formed on the fitting 30 which engage in the material of one or both core halves 41*a*, 41*b*. For example, tabs can be provided all around the center of fitting 30 (with the exception of the front side where the lever mechanism 31 is arranged), which in principle protrude beyond the recess and are located between the two core halves 41*a*, 41*b*. At the edge of the recess 42, corresponding depressions are made in the remaining material of the core halves 41*a*, 41*b*, in particular also milled in, in which the tabs are inserted.

It is also conceivable that along the edge of the recess 42, the extending further side edges 423 are not exclusively formed by angularly adjoining straight sections, but instead, preferably at several points, undercut connecting elements are formed, wherein side panels of the fitting 30 have corresponding mating contours.

A particularly flat gluing of side surfaces of the fitting 30 with the bottom 421 of the recesses 42 has the advantage that in the area of the recess 42, the core halves 41*a*, 41*b* can be recessed except for a particularly thin layer of material, for example only a few millimeters thick, since this thin layer of material of the core halves 41*a*, 41*b* is stabilized by the fitting 30. In this way, a composite element 40 can be created that is only slightly thicker than the installation height of the fitting 30. In the example shown, the fitting 30 has side panels 32 on which the lever mechanism 31 is mounted and between which the lever mechanism 31 enters. These side panels 32 can be used in whole or in part as adhesive surfaces.

Figure 4:
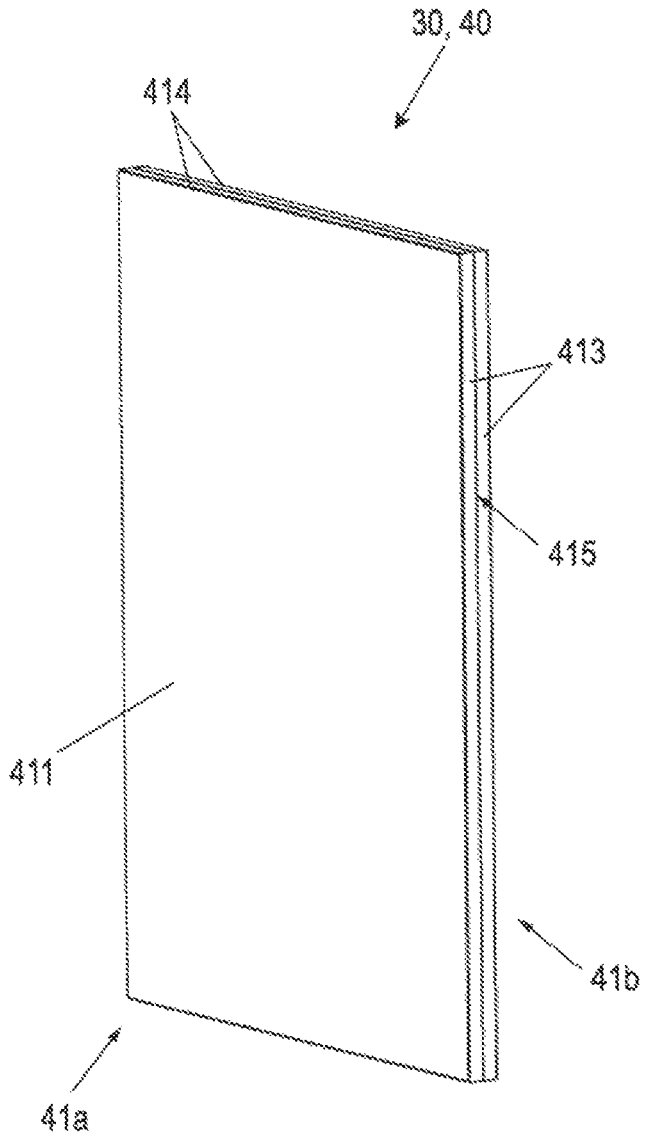

FIG. 4 shows the joined composite element 40, which contains the fitting 30 without being accessible from one of the side surfaces 411 or the end surfaces 413, 414.

Figure 5:
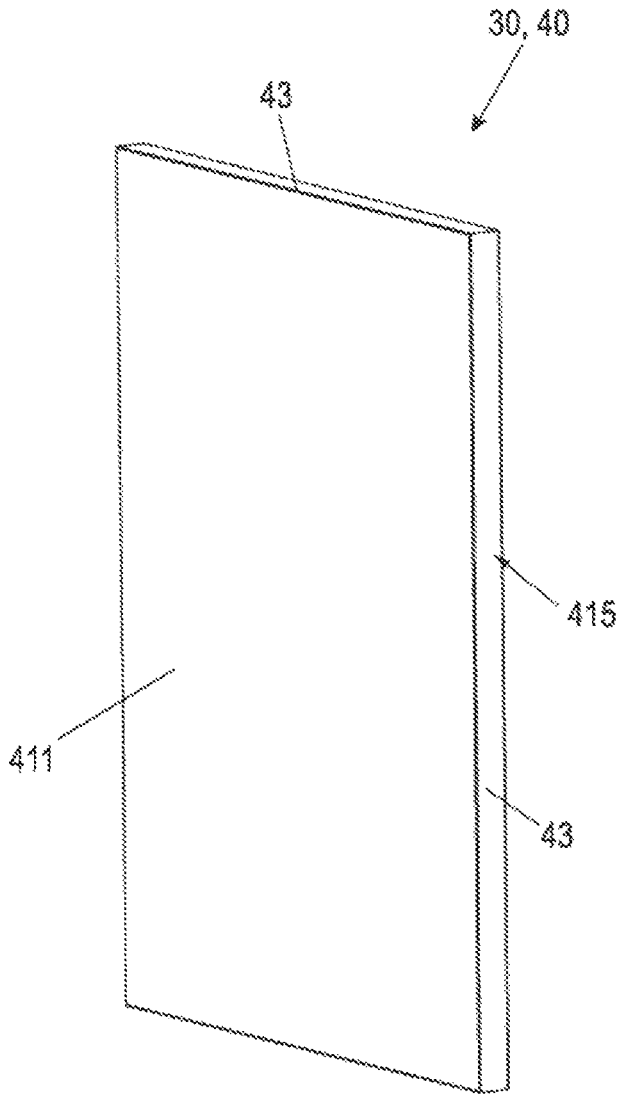

In a following processing step, the result of which is shown in FIG. 5, a narrow-surface coating 43 is applied to preferably all end surfaces 413, 414 of the core halves 41*a*, 41*b*. Due to this narrow-surface coating 43, which respectively covers the width of the end surfaces 413 and 414 of both core halves 41*a*, 41*b*, it is no longer visible that the composite element 40 is composed of two separate core halves 41*a*, 41*b*. Rather, it has the appearance of a single panel, the side surfaces or end surfaces of which are each coated continuously and uniformly.

Plastic, for example, is used as the material for the narrow-surface coating 43. This narrow-surface coating 43 is also preferably already provided with a decorative surface or is painted after application. Its thickness ranges from a few tenths of a millimeter to about 1 or 2 millimeters (mm). Standard industry methods can be used to apply the narrow-surface coating 43. For example, the narrow-surface coating 43 can be formed by an edge band that is fixed, for example, with hot-melt adhesive or by means of an adhesive activated by laser radiation, wherein a lateral projection is removed and trimmed after application by milling and/or peeling with a peeler blade.

Due to tolerances in the dimensions of the core halves 41*a, b* and/or due to processing tolerances, a step may occur between the end surfaces 413, 414 when the core halves 41*a*, 41*b* are joined together. In order to achieve a high-quality narrow-surface coating 43, end surfaces 413, 414 lying on top of each other are advantageously formatted before the narrow-surface coating 43 is applied, wherein the step is removed and a common, flat surface is created, to which the narrow-surface coating 43 is applied. This can be done e.g., by a saw cut performed perpendicularly to the outer side surface 411 or by milling off the end of the end surfaces 413, 414, for example.

Figure 6:
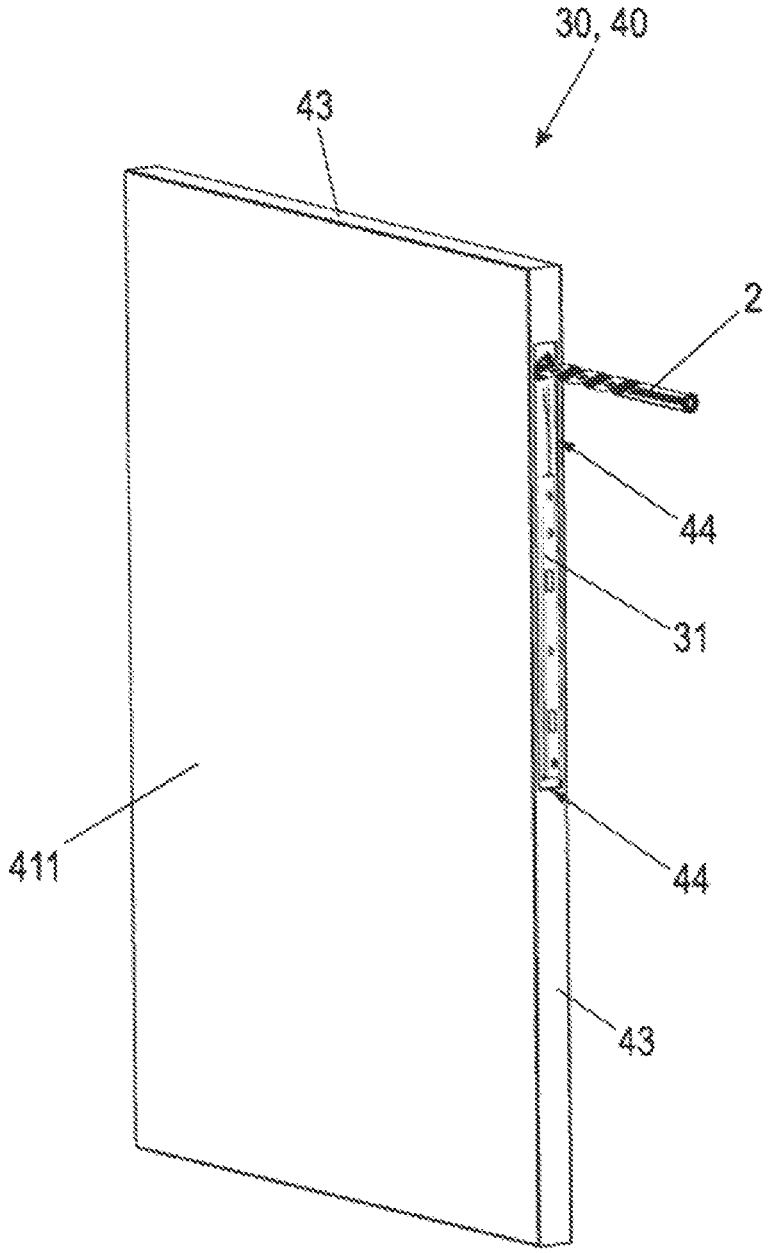

In a last processing step, shown in FIG. 6, a further milling tool 2 is used to mill the composite element 40 on the end surface in the area of fitting 30. In this way, an opening 44 is created through which the lever mechanism 31 of the fitting 30 is accessible. The height of the resulting opening 44 extends over an area of the fitting 30 where the lever mechanism 31 extends. Accordingly, the material webs 415 that delimit the recesses 42 to the front, including the sections of the narrow-surface coating 43 located on them, are essentially removed in this step. The narrow-surface coating 43 remains above and below the opening 44, but optionally also laterally from the opening 44, thus achieving the uniform surface finish of the composite element 40 also on the front end surface.

In order to prevent damage to the fitting 30 and in particular to the lever mechanism 31 during the milling step, the fitting 30 is preferably inserted into the recesses 42 in such a way that a small gap remains between the fitting 30 and the front side edges 422 of the recesses 42, i.e., the material webs 415.

The opening 44 can also be created by alternative methods to milling. The material webs 415 delimiting the recesses 42 to the front, including the sections of the narrow-surface coating 43 located on them, can also be removed by a laser process or another cutting/punching process, for example.

In the example described, the fitting 30 is directly integrated into the composite element 40. However, it can also be provided that during the production of the composite element 40, instead of the complete fitting 30, initially only a fitting housing is inserted into the composite element 40. After production of the opening 44, the actual movement fitting can be inserted into the fitting housing through the opening 44. Preferably, the fitting housing and the then inserted fitting have interacting, e.g., latching, mounting elements, so that the fitting can be mounted easily. It is advantageous in this case that the actual movement fitting is not yet included in the composite element when creating the opening 44 and therefore there is basically no risk of damage or direct contamination of the fitting (e.g., by chips) during the insertion of the opening 44. Another advantage of the two-part design is that different fittings can be inserted into a composite element prepared with the fitting housing and that the fitting can be removed again for repair or replacement if necessary.

Alternatively or additionally, as additional protection for the integrated fitting 30, a cover can be inserted on the side of the opening 44 to be cut out, between the fitting 30 or the fitting housing and the remaining web 415, which cover can be removed after the production of the opening 44 on the end surface. In case of an already inserted fitting 30, this cover is preferably thin. In the case of a fitting housing inserted in the composite element, this cover can also be more solid so that it supports the material webs 415 during the insertion of the opening 44.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE NUMERALS

1 Milling tool
2 Further milling tool
10 Furniture body
11 Bottom panel
12 Top panel
13 Side wall
131 Side surface
132 End surface
133 Opening in end surface
20 Flap arrangement
21 Flap
30 Fitting
31 Lever mechanism
32 Side panel
40 Composite element
41*a*, 41*b* Core half
411 Outer side surface
412 Inner side surface
413 Front end surface
414 Further end surface
415 Remaining web
42 Recess
421 Bottom
422 Front side edge
423 Further side edge
43 Narrow-surface coating
44 Opening in end surface

The invention claimed is:

1. A method for producing a wall for a piece of furniture, the method comprising:

providing two core halves, wherein at least one of the two core halves has at least one recess extending only along a portion of a side surface of the at least one of the two core halves, wherein the two core halves are panels;

inserting a fitting or a fitting housing into the at least one recess and joining the two core halves together to form a composite element enclosing the fitting or the fitting housing, wherein side surface of the at least one of the two core halves rests on a side surface of the other one of the at least two core halves;

applying a narrow-surface coating to at least one end surface of the composite element, wherein the end surface of the composite element is oriented transversely to the side surfaces of the two core halves; and inserting an opening in a portion of the at least one end surface of the composite element, wherein the opening extends into the composite element up to the fitting or the fitting housing.

2. The method of claim 1, wherein the at least one recess projects, except for a material web, up to the at least one end surface of the composite element before the step of inserting the opening.

3. The method of claim 2, wherein the material web and the narrow-surface coating applied to the material web are removed prior to inserting the opening.

4. The method of claim 3, wherein the opening is milled out, lasered out, cut out, or punched out.

5. The method of claim 1, wherein the at least one recess is milled out of the at least one core half.

6. The method of claim 5, wherein the at least one recess is milled out with a milling tool from the side surface of the at least one core half.

7. The method of claim 1, wherein the at least one core half having the at least one recess is produced with the recess in a master molding process.

8. The method of claim 1, wherein the two core halves are glued together.

9. The method of claim 1, wherein the fitting or the fitting housing is bonded to at least one of the two core halves within the at least one recess.

10. The method of claim 1, wherein the fitting or the fitting housing engages in the two core halves with staples or claws for its attachment.

11. The method of claim 1, wherein connecting elements are formed from the two core halves adjacent to the at least one recess, and wherein the connecting elements engage in the fitting or the fitting housing.

12. The method of claim 11, wherein the fitting or the fitting housing has side panels with recesses and the fitting or fitting housing is inserted into the two core halves in such a way that the connecting elements engage in the recesses.

13. The method of claim 1, wherein, prior to the applying of the narrow-surface coating, the at least one end surface of the composite element oriented transversely to the side surface is formatted to obtain a flat end surface.

14. The method of claim 13, wherein the end surface is formatted by sawing or milling.

15. The method of claim 1, wherein a flat coating is applied to an outer side surface, opposite of the at least one recess, of the two core halves before or after joining the two core halves.

16. The method of claim 1, wherein the narrow-surface coating is also applied to further end surfaces of the composite element into which no opening is inserted.

17. The method of claim 1, wherein the fitting has a lever mechanism that guides a movable furniture part of the piece of furniture.

18. The method of claim 17, wherein the lever mechanism is located between outer side surfaces of the wall when the movable furniture part is closed.

19. The method of claim 1, wherein the wall is a side wall or a partition wall of the piece of furniture.

20. The method of claim 1, wherein the fitting is a flap fitting or a door fitting.

* * * * *